United States Patent [19]

Mohrbach

[11] Patent Number: 4,651,608

[45] Date of Patent: Mar. 24, 1987

[54] PIVOTED ARM PUNCHING MACHINE

[76] Inventor: Johannes Mohrbach, 418, Novo Hamburgo-RS, Brazil

[21] Appl. No.: 730,810

[22] Filed: May 3, 1985

[30] Foreign Application Priority Data

May 3, 1984 [BR] Brazil ..... 8402175

[51] Int. Cl.[4] ..... B26F 1/40

[52] U.S. Cl. ..... 83/536; 100/228

[58] Field of Search ..... 83/535–538, 83/541, DIG. 1; 100/226, 228

[56] References Cited

U.S. PATENT DOCUMENTS

| | | | |
|---|---|---|---|
| 1,010,476 | 12/1911 | Buckminister | 83/537 |
| 1,403,491 | 1/1922 | Eaton | 83/537 |
| 2,241,556 | 5/1941 | MacMillin et al. | 83/DIG. 1 |
| 3,212,382 | 10/1965 | Haas | 83/537 |
| 3,522,753 | 8/1970 | Schmied | 83/561 X |
| 3,905,265 | 9/1975 | Peterson et al. | 83/537 |
| 4,070,940 | 1/1978 | McDaniel et al. | 83/DIG. 1 |

FOREIGN PATENT DOCUMENTS

| | | | |
|---|---|---|---|
| 2446715 | 9/1980 | France | 83/537 |

*Primary Examiner*—James M. Meister

*Attorney, Agent, or Firm*—Toren, McGeady and Goldberg

[57] ABSTRACT

A drive for the pivot arm of a pivoted arm punching machine includes an electrical drive motor arranged to drive a driving gear wheel which, in turn, is in meshed engagement with and drives a driven gear wheel secured to the pivot arm. A braking mechanism arranged to stop the driven gear wheel when the drive motor is stopped. The braking mechanism includes a brake lining which is pressed against the driven gear wheel by a brake plate. The brake plate is actuated by a pneumatic cylinder located within the punching machine when the drive motor is stopped.

7 Claims, 4 Drawing Figures

PIVOTED ARM PUNCHING MACHINE

BACKGROUND OF THE INVENTION

The present invention is directed to an improved pivoted arm punching machine having a pivot arm secured on a vertical post which includes a handwheel for vertical adjustment of the arm. The post is located within a housing and a stationary table positioned on the housing forms a working surface or cutting block for the punching machine. A control console is provided as a part of the housing.

Pivoted arm punching machines are known. The punching head is controlled by pneumatic or hydraulic means mounted in the machine housing. Such means swing the pivot arm or head horizontally around the post and also press the head vertically downwardly for pressing a cutting knife through leather locating on the work surface of the table so that leather cutouts are formed.

Known pivot arms, however, have a number of disadvantages in operation. The action of the pneumatic or hydraulic means for moving the head is slow and, as a result, the horizontal and vertical movements of the head or pivot arm which should be performed normally to one another, are superimposed into a downwardly directed diagonal movement. Due to such oblique movement, the cutting knives are displaced laterally and are subject to damage. At the same time, the working surface or cutting block formed by the stationary table is prematurely worn. A person operating the punching machine must swing the pivot arm and, therefore, tires easily. Further, constant maintenance costs result.

SUMMARY OF THE INVENTION

The primary object of the present invention is to improve a pivoted arm punching machine of the type mentioned above so that the movements of the head or pivot arm take place perpendicularly to one another and follow one after the other in a very rapid manner so that the maximum working speed can be attained with the least wear. Moreover, the person operating the punching machine can move the pivot arm without expending any force.

In accordance with the present invention, a driven member is secured to the pivot arm and is driven by a driving member. Both the driven and driving members are flat circular members arranged horizontally in the punching machine and preferably are in the form of gear wheels with teeth formed around their outer circumferences. Preferably, the driving member is connected to an electric drive motor positioned vertically within the punching machine housing and controlled from a control console on the housing.

As compared to pneumatic or hydraulic means, electric drive motors have the advantage that they start up and brake more rapidly. Accordingly, the pivotal movement of the pivot arm is accelerated so that the pivot arm reaches the desired position before the vertical downward driving movement of the head or pivot arm is effected by a conventional pneumatic device. An advantageous feature of the pivoted arm punching machine, in accordance with the present invention, is the acceleration of the working process, by utilizing a braking mechanism which acts on the driven member connected to the head or pivot arm for stopping the movement of the pivot arm when the electric drive motor is stopped. The braking mechanism consists of a flat brake lining positioned on a brake plate located below the driven member. The brake plate is driven by pneumatically actuated vertically arranged actuating members located within the housing.

Accordingly, the braking mechanism acts as a disc brake and stops the pivotal movement of the head or pivot arm caused by the drive motor, and in particular the movement caused by the inertia of the mass of the head. Due to the braking action, the pivotal movement can be considerably accelerated without the danger of the horizontal and vertical movements of the head or pivot arm being superimposed and resulting in disadvantages diagonal movement. Damage to the cutting knife and the cutting table experienced in the past when the punching machine is operated in a rapid manner, are now completely eliminated.

In accordance with the present invention, the pivot arm can return automatically to its starting position after each working stroke. This arrangement is particularly advantageous when a safety system is used made up of a number of photocells forming a light barrier around the punching machine. When the light barrier detects that a person has extended his hand into the working area of the head, it emits a signal to the control for releasing the disc brake and driving the motor in the reverse rotational direction.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAIILED DESCRIPTION OF THE INVENTION

Figure 1:
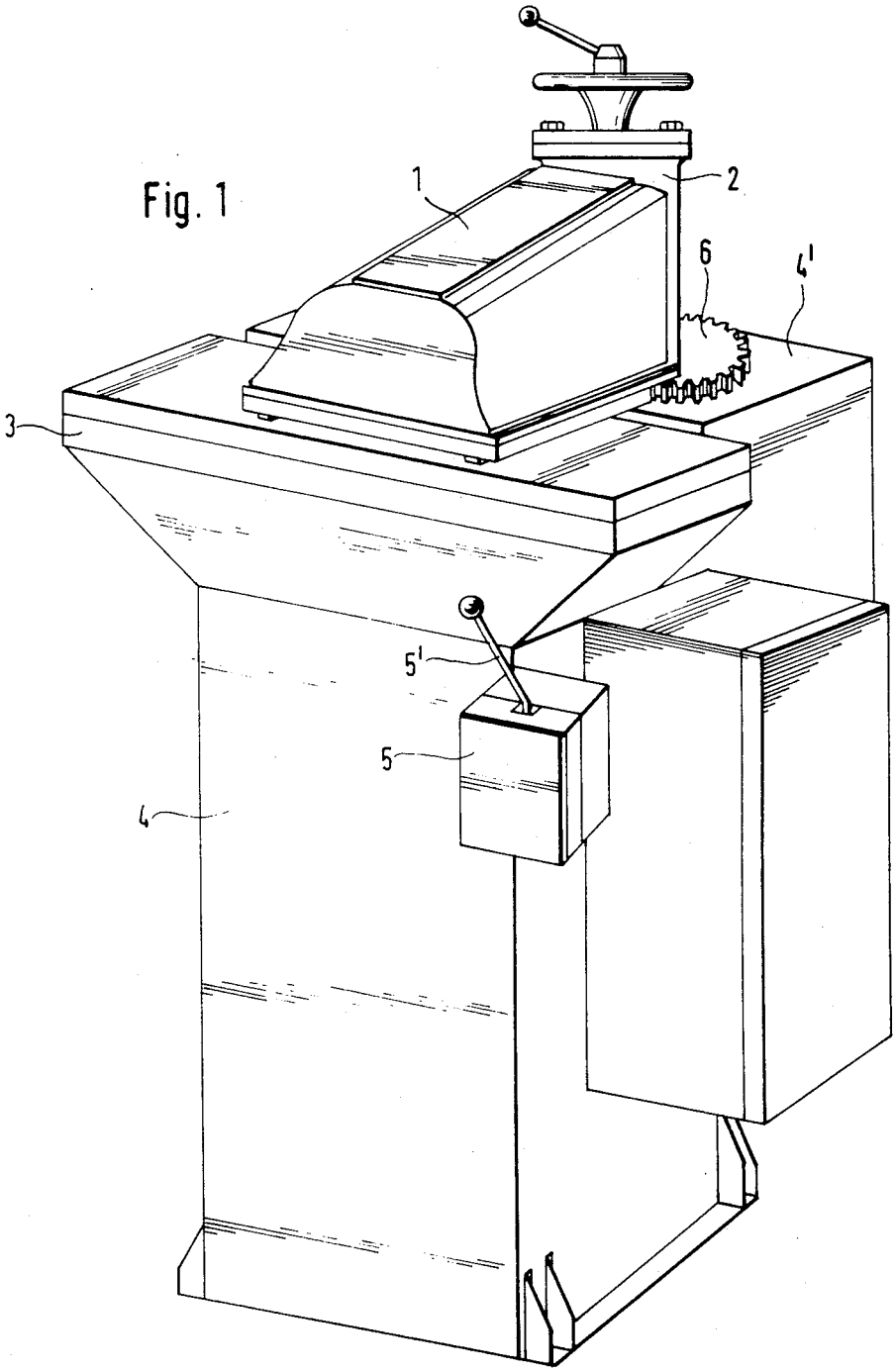
FIG. 1 is a schematic perspective view of a pivoted arm punching machine.

In FIG. 1 the pivoted arm punching machine is shown in perspective. An upwardly extending standard or housing 4 mounts a stationary cutting table 3 with a horizontally arranged cutting surface. At the rear side of the housing 4 a vertically extending post 2 mounts a pivotal head or arm 1 so that the arm can be pivoted through a horizontal arc and can also be lifted and lowered. A handwheel mounted on the upper end of the post 2 affords the vertical adjustment of the arm or head 1. A control console 5 including a control handle 5' is located on the housing and by manipulating the handle 5' the pivot arm or head 1 can be moved upwardly or downwardly and it can be pivoted through a horizontal arc. A cover 4' forming part of the housing 4 encloses components of the punching machine.

Figure 2:
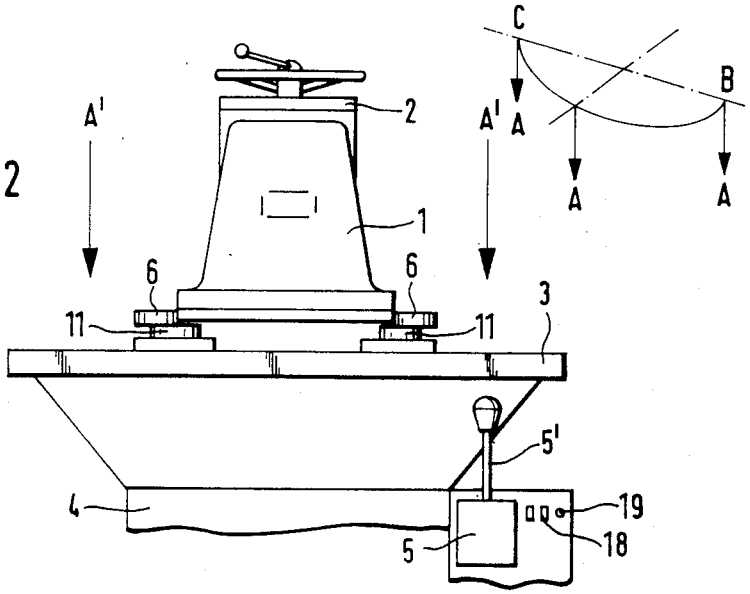
FIG. 2 is a partial front view of the machine shown in FIG. 1.

In FIG. 2 a front view of the punching machine is illustrated. The pivot arm or head 1 is located in its initial position extending upwardly from the working surface of the cutting table 3. The stroke or upward and downward movement of the head 1 is designated by the letter A'. The pivotal movement and the stroke movement extend perpendicularly of one another and, as a result, the initial pivotal movement must be carried out very quickly. A driven member or gear wheel 6 is fixed to the post 2. Below the gear wheel 6 on each of the opposite sides of the post 2 is a pneumatic cylirder 11. Each cylinder 11 has a piston for pressing a brake device against the underside of the gear wheel 6 for stopping its pivotal movement.

Further, on the control console a reversing switch 18 is provided for changing between manual operation and automatic operation. A potentiometer 19 is provided on the control console for programming the automatic movement of the head 1. On the right in FIG. 2, the possible directions of movement of the control handle in the control console 5 are designated with the letters A for the lifting and lowering movement, with the letter B for pivotal movement in the counterclockwise direction, and with C for pivotal movement in the clockwise direction.

Figure 3:
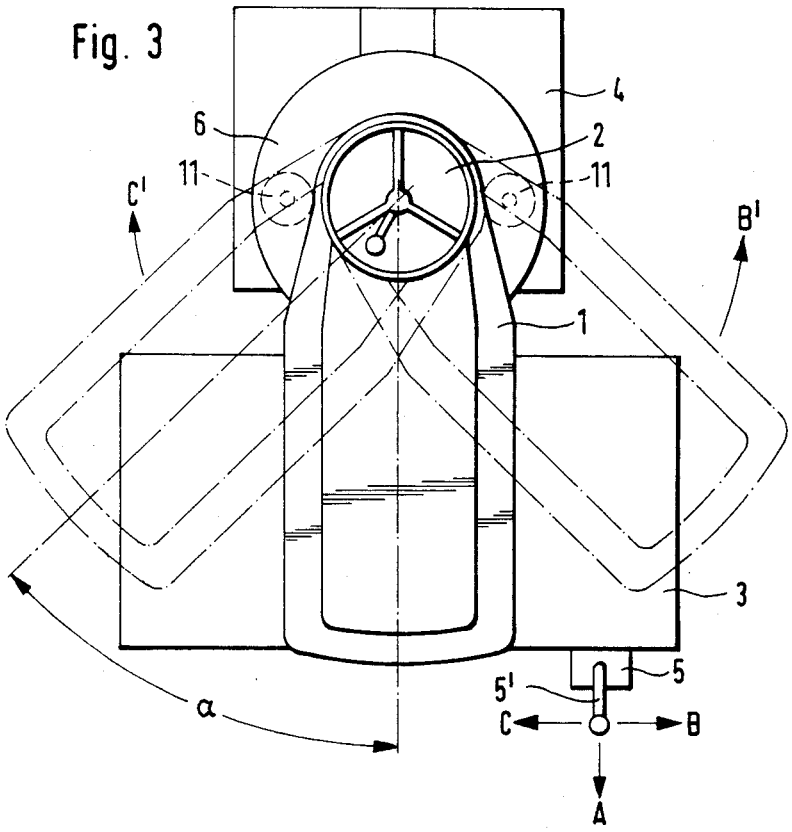
FIG. 3 is a top view of the machine shown in FIG. 2.

In FIG. 3 a top view of the machine in FIG. 2 is provided. The solid lines show the pivot arm or head 1 in its initial or starting position, while the dashed lines show the head pivoted into the right and left positions, respectively. In this way the movement of the head 1 can cover the complete working surface of the cutting table 3. The pivotal movement in the counterclockwise direction is designated by B' and in the clockwise direction by C'. Manual control is carried out by the handle 5' on the control console 5 with the movement of the handle corresponding to the desired movement of the pivot arm or head 1. In FIG. 3 it can be seen that the driver gear wheel 6 is fixed to the post 2. Further, the two pneumatic cylinders 11 are indicated for actuating the brake device. The pneumatic cylinders are actuated by an electrically actuated pneumatic valve, not shown.

Figure 4:
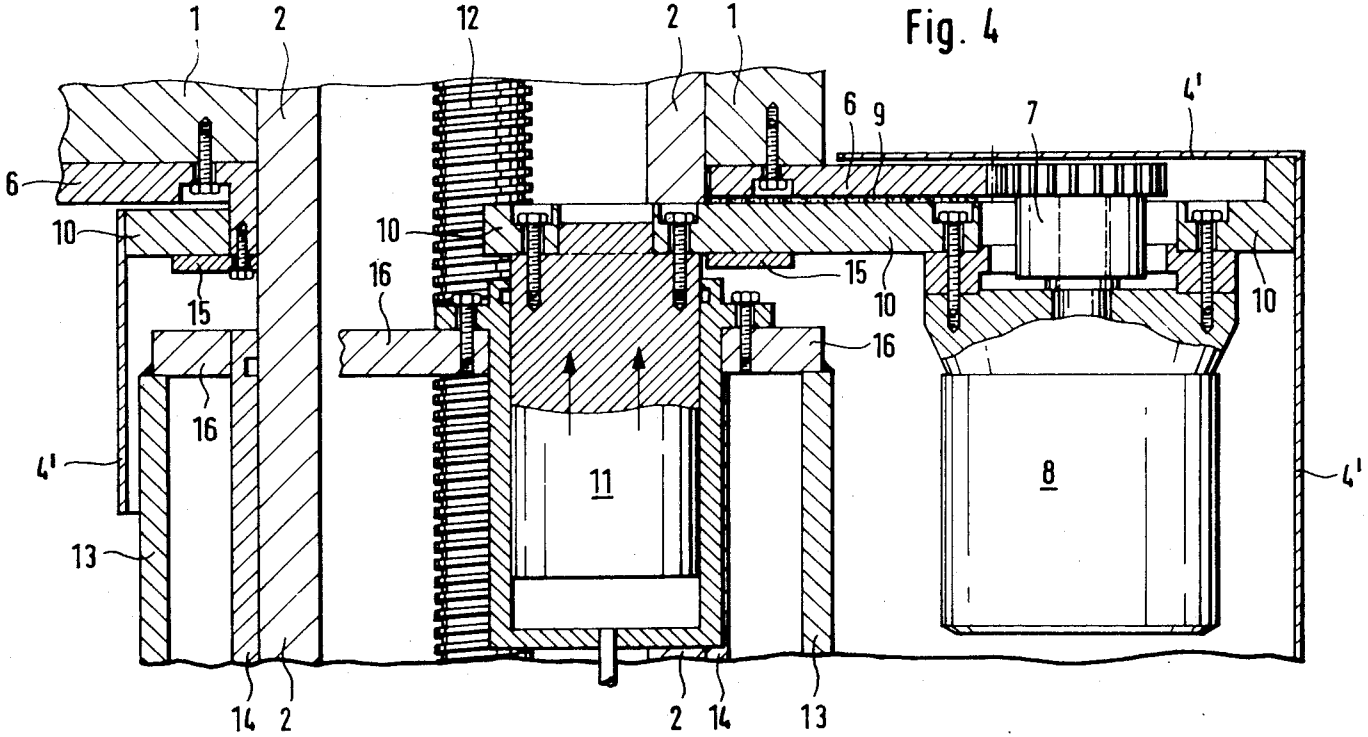
FIG. 4 is a partial cross-sectional view through the punching machine in the region of the pivotal drive and the brake mechanism.

FIG. 4 is a sectional view through the region of the pivoted arm punching machine which carries out the driving and braking of the pivot arm or head 1. Head 1 is supported on the post 2 so that it can be pivoted as well as being moved upwardly and downwardly. The height of the upward and downward movement can be adjusted by a threaded spindle 12. The driven member 6, in the form of a gear wheel with teeth around its radially outer circumference, is secured to the head 1. A driving member 7 also in the form of a gear wheel with teeth around its radially outer circumference is in meshed engagement with the teeth on the driven member or gear wheel 6 and is connected to an electric drive motor 8. The drive motor 8 is arranged vertically within the housing 4. As soon as the drive motor 8 starts to run, the head or pivot arm 1 is pivoted around the post 2 by the meshed engagement between the driving member 7 and the driven member 6.

Adjacent the underside of the driven gear wheel 6 there is the brake device including a brake plate 10 with a brake lining 9 on its upper surface facing toward the underside of the gear wheel 6. The brake plate 10 is lifted and lowered by the pneumatic cylinders 11. If the brake plate 10 is moved upwardly, the brake lining 9 bears against the underside of the driven gear wheel 6 causing the pivotal movement of the pivot arm or head 1 to be stopped immediately. The pneumatic cylinders 11 are fitted into a mounting plate 16 on opposite sides of the post 2. The mounting plate 16 is attached to the vertical parts 13 of the housing 4.

The post 2 is pivotally supported in a bushing 14 so that it can be lifted and lowered. The bushing 14 is secured to the housing 4.

The brake plate 10 is movably supported on a mounting ring 15 located below the brake plate. The travel of the brake plate 10 amounts approximately to 0.5 mm.

In manual operation, the control of the pivot arm or head 1 is carried out as follows:

When the control lever 5' in the control console 5 is moved in the direction B or C, the head pivots horizontally in the direction B' or C', respectively. As soon as the control handle is released the pneumatic cylinder 11 is placed in operation and the pivotal movement of the head is braked immediately with the head coming to an immediate stop.

By moving the control lever 5' in the direction A, the head 1 is moved downwardly in the direction A'. As soon as the control handle is released the head moves upwardly to its upper starting position.

In semi-automatic operation the head 1 performs as follows:

Initially, the switch 18 is placed on automatic. The desired stroke movement of the head is taken over by the potentiometer 19. Next, the control handle 5' is moved in the direction B or C until the desired pivoted position is reached. When the pivoted position has been reached, the control handle 5' is drawn in the direction A and the pivot arm or head 1 undergoes the desired stroke movement. Upon completion of the stroke movement, the head 1 automatically returns into the starting position.

While specific embodiments of the invention have been shown and described in detail to illustrate the application of the inventive principles, it will be understood that the invention may be embodied otherwise without departing from such principles.

I claim:

1. An improved pivoted arm punching machine comprising a housing, a control console mounted on said housing, a stationary table positioned on said housing and having a horizontal working surface thereon, a generally vertically extending post located within said housing and extending upwardly from said table, a pivot arm mounted on said post for pivotal movement along a horizontal path about said post above the working surface of said table, wherein the improvement comprises a driven member attached to said pivot arm within said housing, a driving member in said housing in operative engagement with said driven member for pivoting said pivot arm about said post, and an electric motor connected to said driving member for driving said driving member, said driven member is a horizontally arranged flat circular gear wheel with teeth formed around the outer circumferential periphery of said wheel, and said driving member is a flat circular gear wheel with teeth formed around the outer circumference thereof with the teeth on said driving member in meshed engagement with the teeth on said driven member, said driving member being horizontally arranged, a braking mechanism located within said housing and arranged to act on said driven member, said braking mechanism comprises a horizontally arranged brake plate, a flat brake lining mounted on said brake plate, and means in engagement with said brake plate for pressing said brake lining on said brake plate against said driven member.

2. Pivoted arm punching machine, as set forth in claim 1, wherein said means for pressing comprises pneumatically actuated members located within said housing and arranged to contact said brake plate for pressing said brake lining against said driven member.

3. Pivoted arm punching machine, as set forth in claim 1, wherein said braking mechanism is arranged to stop the pivotal movement of said pivot arm before said pivot arm is moved downwardly toward said table.

4. An improved pivoted arm punching machine comprising a housing, a control console mounted on said housing, a stationary table positioned on said housing and having a horizontal working surface thereon, a generally vertically extending post located within said housing and extending upwardly from said table, a pivot arm mounted on said post for pivotal movement along a horizontal path about said post above the working surface of said table, a driven member is attached to said pivot arm within said housing, said driven member is a horizontally arranged flat circular gear wheel with teeth formed around the outer circumferential periphery of said wheel, a driving member in said housing disposed in operative engagement with said driven member for pivoting said pivot arm about said post, said driving member is a flat circular gear wheel with teeth formed around the outer circumference thereof with the teeth on said driving member in meshed engagement with the teeth on said driven member, wherein the improvement comprises an electric motor connected to said driving member for driving said driving member, a braking mechanism located within said housing and arranged to act on said driven member, said braking mechanism comprises a horizontally arranged brake plate, a flat brake lining mounted between said brake plate and said driven member, and means in engagement with said brake plate for pressing said brake plate and said brake lining against said driven member.

5. An improved pivoted arm punching machine, as set forth in claim 4, wherein said means for pressing comprises pneumatically actuated members located within said housing and arranged to contact said brake plate for pressing said brake lining against said driven member.

6. An improved pivoted arm punching machine, as set forth in claim 4, wherein said braking mechanism is arranged to stop the pivotal movement of said pivot arm before said pivot arm is moved downwardly toward said table.

7. An improved pivoted arm punching machine, as set forth in claim 4, 5 or 6, wherein said driving member is horizontally arranged.

* * * * *